US005125766A

United States Patent [19]

de Wit

[11] Patent Number: 5,125,766

[45] Date of Patent: Jun. 30, 1992

[54] MECHANICAL AUTOMATIC TILTING WEIR WITH SELFADJUSTING LOWERING OF THE WEIR-LEVEL DURING LARGER DISCHARGES

[76] Inventor: Wilhelmus G. J. de Wit, Vlas oord 20, Houten, Netherlands, 3991 XC

[21] Appl. No.: 460,948

[22] PCT Filed: Sep. 1, 1988

[86] PCT No.: PCT/EP88/00789

§ 371 Date: Mar. 2, 1990

§ 102(e) Date: Mar. 2, 1990

[87] PCT Pub. No.: WO89/02006

PCT Pub. Date: Mar. 9, 1989

[30] Foreign Application Priority Data

Sep. 4, 1987 [NL] Netherlands ..... 8702118
Nov. 13, 1987 [NL] Netherlands ..... 8702726

[51] Int. Cl.[5] ..... E02B 7/28

[52] U.S. Cl. ..... 405/94; 405/96; 405/100; 405/104; 405/106

[58] Field of Search ..... 405/80, 87, 92, 94, 405/95, 96, 99, 100, 93, 104, 105, 106

[56] References Cited

U.S. PATENT DOCUMENTS

| | | | |
|---|---|---|---|
| 1,497,618 | 6/1924 | Vonka | 405/100 |
| 1,738,051 | 12/1929 | Harker | 405/89 |
| 2,322,846 | 6/1943 | Growden et al. | 405/100 X |
| 2,966,777 | 1/1961 | de Brito Filho | 405/94 |
| 4,877,352 | 10/1989 | Tuttle et al. | 405/100 X |

FOREIGN PATENT DOCUMENTS

| | | | |
|---|---|---|---|
| 582838 | 8/1933 | Fed. Rep. of Germany | 405/100 |
| 690384 | 4/1940 | Fed. Rep. of Germany . | |
| 1008666 | 5/1957 | Fed. Rep. of Germany . | |
| 645345 | 10/1928 | France . | |
| 2033187 | 12/1970 | France . | |
| 2270389 | 12/1975 | France . | |

*Primary Examiner*—Randolph A. Reese
*Assistant Examiner*—Arlen L. Olsen
*Attorney, Agent, or Firm*—Wegner, Cantor, Mueller & Player

[57] ABSTRACT

The invention concerns a weir with an on a horizontal axis tilting gate (1). The control is automatic and completely mechanical and operates without an external source of energy. The control uses a float/counterweight (4) placed in an enclosure (5) which is in connection with the upstream level. The float/counterweight (4) is connected to the equator (13) on the gate (1) by a transmission mechanism consisting of (7), (10) and (11). The float/counterweight (4) is in balance with the hydraulic forces on the gate (1). The tilting axis is placed about 0.4 of the height of the gate (1) from the underside.

During large discharges the gate (1) tilts further to increase the flow. This enables the weir to establish within shorter time the desired level. A horizontal submerged grate (15) prevents choking of the weir.

The gate (1) can adjusted vertically by a leadscrew (16) to set the weirlevel. A threshold-beam (20) is connected to guidings (17) to the gate-equilibrium by every adjusted height.

2 Claims, 3 Drawing Sheets

MECHANICAL AUTOMATIC TILTING WEIR WITH SELFADJUSTING LOWERING OF THE WEIR-LEVEL DURING LARGER DISCHARGES

The invention concerns weir gate (1) tilting on a horizontal axis that maintains mechanically a preset weirlevel entirely automatically but can be adjusted thus that in times of a larger flow of water even a lowering of the preset weirlevel is obtained.

The operation is based on a balanced equilibrium between the hydraulic forces exercising on the gate (1) and the resisting forces of 1 or 2 floating counterweights (4).

The horizontal pivot (2) is mounted sligtly below the centre of the gate (1). The forces are transmitted by means of an adjustable connection (13), a cable (14), an adjustable drum (11), a disk (10) welded on a shaft (7) and a cable (6).

A grate (15) prevents floating treebranches and waterplants to get in between the underside of the gate (1) and the threshold-beam (20). Gate (1) and grate (15) are hanging in a spindle- or lifting structure (16) which permits the adjustment of different weirlevels.

Most of the presently used weirs, capable of complete, automatic holding of the desired weirlevel, all need a mechanism electrically or hydraulically driven. The disadvantage of these weirs is that they are costly to install, especially when there is no electricity available in the vicinity.

In the past weirs have been designed which have an automatic level-control based on the hydraulic forces exercised on the gate with or without counterweights.

Weirs of this type are known from the French paper FR-A-645.345 and FR-A-2.033.187. The main disadvantage is that these weirs only function for one specified weirlevel. When the counterweight of FR-A-645.345 is changed to alter the weirlevel the whole characteristic of the weir is disturbed. When the weirgate is partially opened, dirt and/or branches can hook or get stuck between the bottom of the weirgate and the threshold, which results in blocking the operating of the weir.

Furthermore, the weir reacts slowly. The weir of FR-A-2.033.187 will discharge large volumes of water when the downstream level rises. This can lead to open the gate completely and the weirlevel falls down under the wished level. The operation of the weir depends on the functioning of a relatively small outlet which can easily be blocked by leaves or other dirt. Blocking this outlet will result in a faulty operation of the weir.

The subject invention is free from the above mentioned disadvantages and above that the weir operates without external energy supply.

Figure 1:
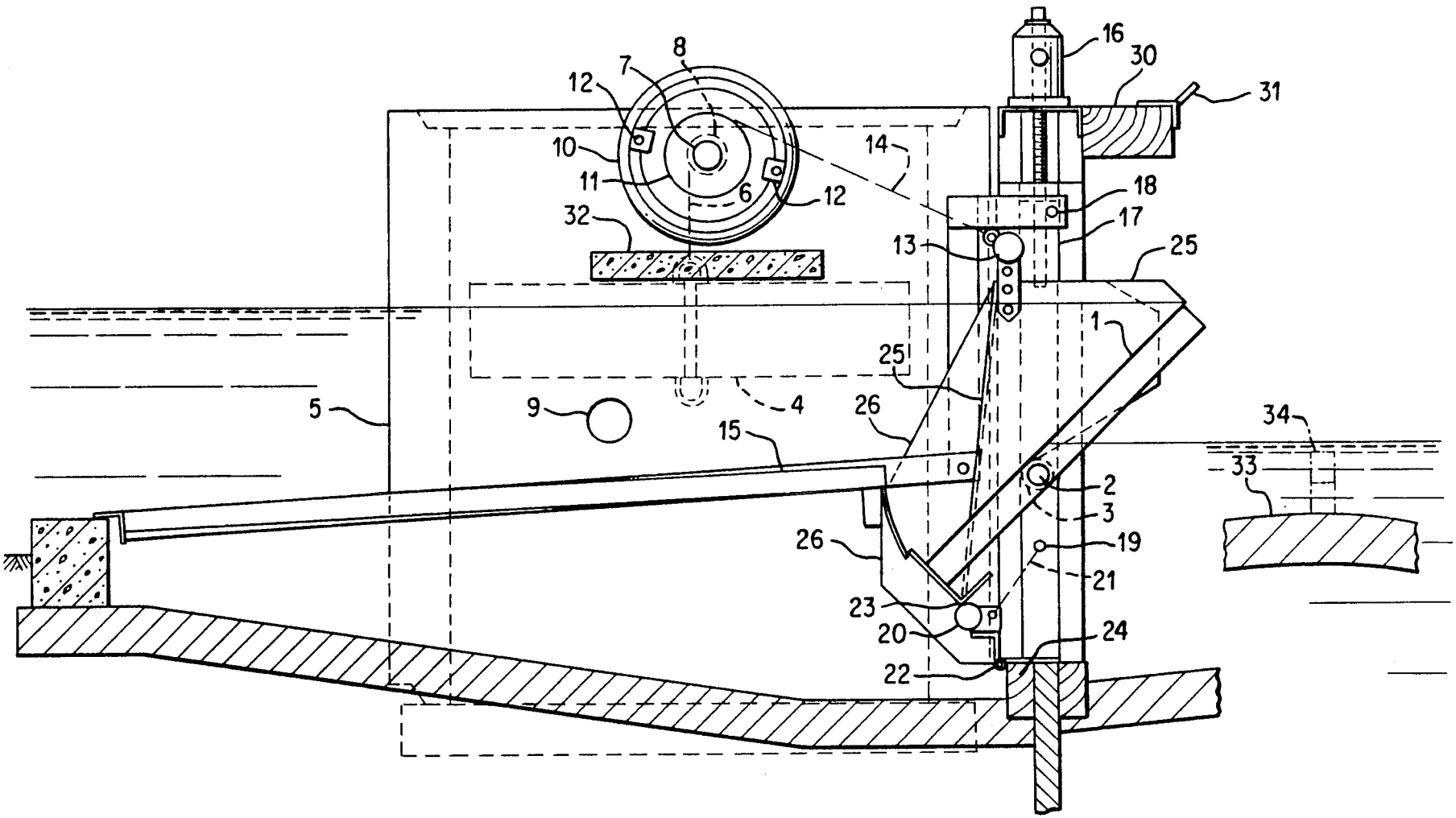
FIG. 1 shows the weir cut through longitudinal.
Figure 2:
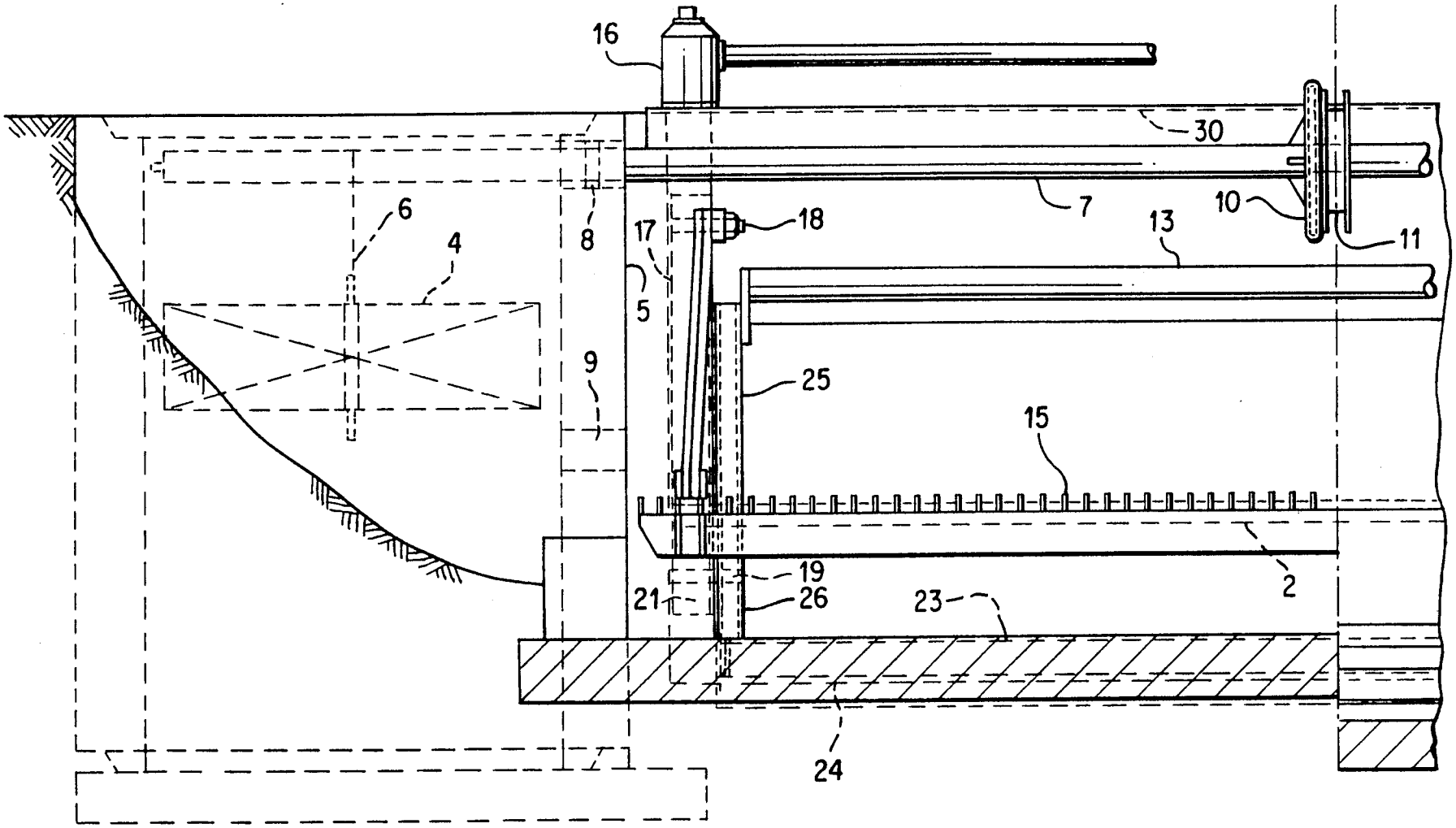
FIG. 2 shows the weir cut cross.

The weir consists of five major parts, namely a tiltable weirgate (1), one or two floating counterweights (4), a leadscrew or lifting construction (2), a grate (15) and a threshold-beam (20). The gate (1) turns with a horizontal fixed shaft (2) in a bearing (3) placed on both sides next to the gate (1) and is vertically adjustible. This horizontal shaft (2) is mounted about 0.4 of the height of the gate measured from the underside. Presumed is that the weirlevel is equal or slightly higher than the upperside of the gate (1). These assumptions results in that the gate (1), only by the hydraulic forces, is nearly in equilibrium. The second essential part of the invention is the use of 1 or 2 floating counterweights (4) placed upstream of the weir, and near the gate (1).

These floating counterweigts (4) are hanging in an enclosure (5) by a steel cable (6) to a horizontal shaft (7), which is positioned above the waterlevel. The cable is wound around the shaft (7), in the way the cable is wound on a drum and fastened to a shaft (7). This shaft rotates on both sides in a bearing (8) mounted in the side of enclosure (5) near the gate (1).

In the same side is an opening (9) placed amply below weirlevel which provides that the waterlevel in the enclosure (5) is always equal to the level in the canal. Instead of these openings (9) to the water near the gate (1) it is also possible to connect the enclosures (5) by way of a tube, well below the watersurface, with a point of the upstream canal at a certain distance. The level in enclosures (5) corresponds then with the level on that point. In this way it is possible to influence the control of the weir at a distance.

On the shaft (7) is welded a fixed disk (10) and is mounted a rotatable drum (11) with an extending rim, and concentric with the shaft (7). The drum (11) is clamped by the rim with some bolts and clamping plates (12) to the disk (10) and may be adjusted at will. Another solution is a worm and wormwheel transmission.

Disk (10) and drum (11) are intended to adjust the correct counterweight after changing the vertical position of the gate (1) with the leadscrew construction (16).

The gate (1) is indirectly connected to the drum (11). This fixing structure (13) can consist of an adjustible equator so that the forces from the drum (11) distribute equally to both ends of the gate (1), or can consist of an adjustable construction on one side of the gate.

Floating counterweights (4) and gate (1) are thus connected indirectly, while the gate (1) is kept closed by the floating and at the same time hanging floating counterweights (4), until the level of the water is rising. A slight rising of the waterlevel results in two effects:

a. the downward force executed by the floating counterweights reduces when the water level rises as a result of the increased on the upward force of the water executed on the floating counterweights, and b. as a result of the increase of the hydraulic forces on the gate, it causes a larger momentum in reference to the turning point in bearing (3), which causes the gates (1) to tilt forward.

These are 2 influences that support each other to have the gate (1) react when the waterlevel rises.

To have a sufficient tilting of the gate (1) when a slight rising of the level occurs an enlarging transmission of floating counterweights (4) to the gate is incorporated by using the relative large diameter of the drum (11) and the small diameter of the shaft (7). The rate of the enlarging is constant because of the effect that the drum (11) is concentric with the shaft (7) and depending only on the difference of the diameter of the shaft (7) and drum (11).

This is made possible by the chosen point of view that the gate is nearly in equilibrium as a result of the hydraulic forces. Even the choice of a relative small and lightfloat/counterweight (4) is in this way possible. As the gate tilts the changing of the hydraulic forces on the gate causes an increase of momentum, which results in further tilting. This tilting of the gate (1), causing the floating counterweights (4) to lift out of the water, goes on until these floating counterweights (4) product sufficient counterforce and find a new equilibrium. This results in an automatic temporary regulating lowering of the weirlevel at times of larger discharge of water. This results in an increased fall in the upstream canal and as consequence a larger capacity to discharge. This automatic regulation of lowering of the weirlevel can be adjusted by changing of the adjustment of the equator (13) on the gate (1). As the discharge decreases, hydraulic forces and simultaneously the momentum will decrease, causing the gate to close gradually by the influence of the floating counterweights (4), in response to the speed of decrease of the water discharge. Because of the tilting construction of the gate (1) there will also start a stream of water below the gate (1) when the gate (1) tilts. Floating dirt, like branches, could attach itself to the gate (1), which can prevent the closure when discharge decreases. To overcome this problem a grate (15) that is almost horizontal, below the waterlevel and near the gate (1) vertically is movable, placed about the level of the turning point of the gate (1). The almost horizontal placing and the direction of the grate-bars parallel to the direction of the stream have the result that the grate (15) hardly silt with plants and other suspended dirt; most of the dirt is carried along over the gate (1) by the stream.

For the adjustment of different summer-, winter-, and intermediate-weirlevels there is a leadscrew construction (16) with guides (17) provided on and in the sides of the "weir construction" which has a central operating handle. Every guide (17) incorporates the bearing (3), permitting the gate (1) to tilt, a fixed bolt (18) that bears the grate (15) and a fixed bolt (19) to which the threshold-beam (20) is fixed by means of a connection (21). This threshold (20) rotates by a hinge (22) when the guiding (17) is moved up- or downward by means of the leadscrew construction (16). This results in no changing of the distance from the striking point (23) to the tilting axis of the gate (1). This is necessary to keep the starting equilibrium.

Figure 3:
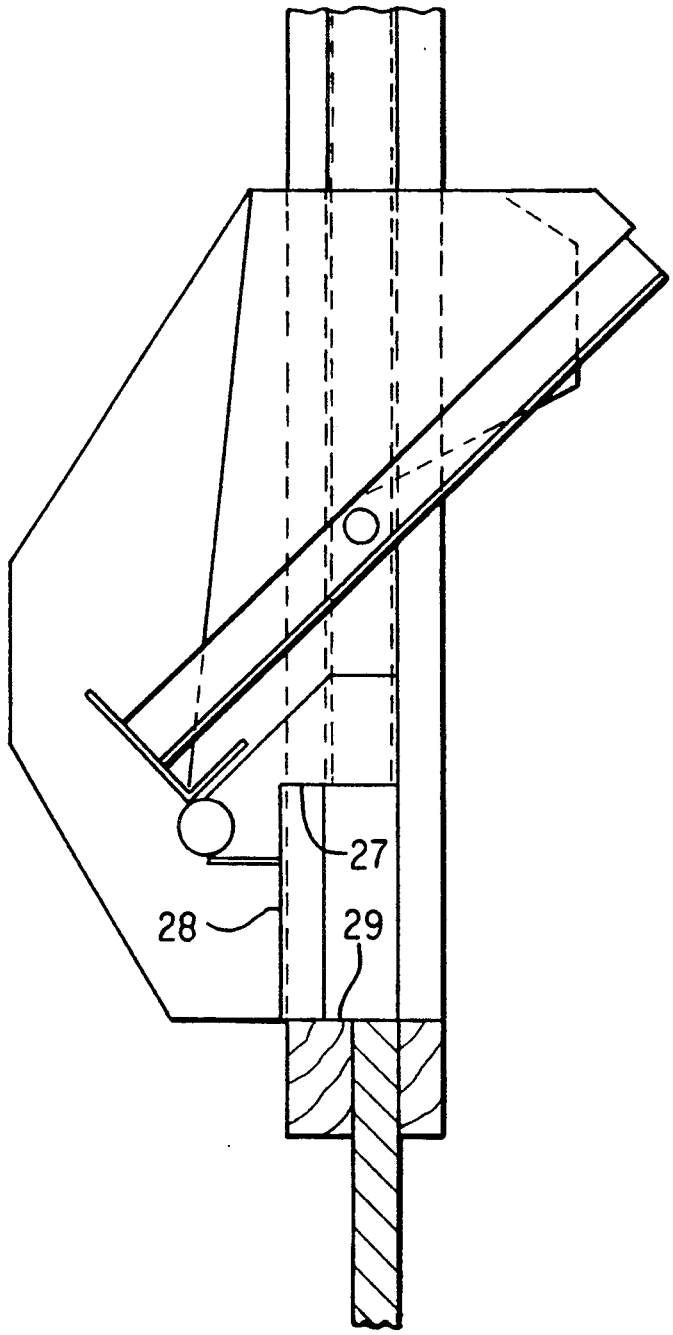
FIG. 3 shows a version of the threshold.

The hinge (22) itself is connected to the weir threshold (24). On both sides of the flat gate (1) is mounted a plate (25) moving with the gate (1), and a plate (26) which is mounted on the side of the fixed weir-structure. The cleft between the plates (25) and (26) is sealed with rubber profiles. Instead of a threshold-beam with a hinge there is also another design possible. (see FIG. 3). A plate (27) is welded to the guides (17). Between these 2 plates is mounted the threshold-beam (28). When the guides (17) are moved up and down means of the leadscrew (16) are the threshold-beam (28) is sliding in front of the weir threshold (29). With this solution the gate (1) will keep the same angle of incidence when the weirlevel is changed.

To ease the adjustment of the position of the gate (1) there is a beam (30) on the weir structure on which a pin (31) is mounted. With the help of a flat steel bar, provided with a handle, several holes and a hook on the bottomside, it is possible to arrest the gate (1) while adjustments are made.

To make adjustments of disk (10) and drum (11) possible, there is provided a wide concrete gangway (32).

If the downstream level can be verry different, it is necessary to build a simple, but wide threshold-beam construction (33), if necessary provided with detachable beams (34).

I claim:

1. Weir with a gate-adjustment depending on the water discharge provided with a vertical adjustable tilting gate where the inclination of the gate is determined by the equilibrium between hydraulic pressure on the gate and an enclosure containing at least one floating counterweight which is connected by way of a cable transmission to the gate that multiplies the movement of the gate compared with the movement of the at least one connected floating counterweight, wherein the gate tilts about a horizontal axis, placed slightly underneath the center of the gate whereby the enclosure containing the at least one floating counterweight is in open connection with the weir-level, and wherein the cable transmission includes a cable drum and shaft with different diameters but being concentric with their axis, and having the seizing point of the adjusting cable to equator placed above and outside the plane of the gate and incorporates an adjustment possibility, wherein the threshold sealing is realised by means of a threshold beam that rotates with a hinge and is connected to a plurality of vertical movable guidings of the gate.

2. Weir with a gate-adjustment depending on the water discharge provided with a vertical adjustable tilting gate where the inclination of the gate is determined by the equilibrium between hydraulic pressure on the gate and an enclosure containing at least one floating counterweight which is connected by way of a cable transmission to the gate that multiplies the movement of the gate compared with the movement of the at least one connected floating counterweight, wherein the gate tilts about a horizontal axis, placed slightly underneath the center of the gate whereby the enclosure containing the at least one floating counterweight is in open connection with the weir-level, and wherein the cable transmission includes a cable drum and shaft with different diameters but being concentric with their axis, and having the seizing point of the adjusting cable to equator placed above and outside the plane of the gate and incorporates an adjustment possibility, wherein an almost horizontal grate is provided that reaches near the gate and is connected to a plurality of vertical movable guidings of the gate.

* * * * *